US009847198B2

(12) United States Patent
Mills et al.

(10) Patent No.: US 9,847,198 B2
(45) Date of Patent: Dec. 19, 2017

(54) PLUG-IN POWER CONTACTOR AND SYSTEM INCLUDING THE SAME

(71) Applicant: LABINAL, LLC, Denton, TX (US)

(72) Inventors: Patrick Wellington Mills, Bradenton, FL (US); James Michael McCormick, Bradenton, FL (US); David Michael Geier, Punta Gorda, FL (US)

(73) Assignee: LABINAL, LLC, Denton, TX (US)

( * ) Notice: Subject to any disclaimer, the term of this patent is extended or adjusted under 35 U.S.C. 154(b) by 489 days.

(21) Appl. No.: 14/488,736

(22) Filed: Sep. 17, 2014

(65) Prior Publication Data

US 2015/0076904 A1 Mar. 19, 2015

Related U.S. Application Data

(60) Provisional application No. 61/879,884, filed on Sep. 19, 2013.

(51) Int. Cl.

| | |
|---|---|
| ***H01H 47/02*** | (2006.01) |
| ***H01H 50/54*** | (2006.01) |
| ***H01H 50/02*** | (2006.01) |
| ***H01H 50/64*** | (2006.01) |

(52) U.S. Cl.

CPC ..... *H01H 50/54* (2013.01); *H01H 47/02* (2013.01); *H01H 50/02* (2013.01); *H01H 50/021* (2013.01); *H01H 50/64* (2013.01); *Y10T 307/391* (2015.04)

(58) Field of Classification Search

CPC ..... H01H 47/02; H01H 50/021

See application file for complete search history.

(56) References Cited

U.S. PATENT DOCUMENTS

| | | | |
|---|---|---|---|
| 3,828,286 | A | 8/1974 | Bain |
| 4,037,183 | A | 7/1977 | Gaskill |
| 5,018,043 | A | 5/1991 | Moreau |
| 5,606,299 | A | 2/1997 | Innes et al. |
| 7,994,653 | B2 | 8/2011 | Gibson et al. |
| 2004/0014356 | A1 | 1/2004 | Hallitschke |

FOREIGN PATENT DOCUMENTS

| | | | |
|---|---|---|---|
| DE | 19729595 | C1 | 10/1998 |
| EP | 1069586 | | 1/2001 |
| FR | 2537741 | A1 | 6/1984 |
| GB | 853620 | A | 11/1960 |
| WO | 2012/166379 | | 12/2012 |

OTHER PUBLICATIONS

International Search Report filed in PCT/US2014/056034 dated Jan. 9, 2015.

European Search Report dated Mar. 28, 2017, 7 pages.

*Primary Examiner* — Rexford Barnie

*Assistant Examiner* — Terrence Willoughby

(74) *Attorney, Agent, or Firm* — Rankin, Hill & Clark LLP

(57) ABSTRACT

A power contactor that includes a number of inputs for a number of power sources, a number of outputs for a number of loads, a number of separable contacts for each pair of the number of inputs and the number of outputs, and an electromagnetic coil. The power contactor also includes a control circuit structured to control the electromagnetic coil to cause the number of separable contacts to open or close, and a plurality of plug-in pins. Each of the plug-in pins is for a corresponding one of the number of inputs and the number of outputs, and is structured to plug into a backplane socket. The power contactor also includes an electrically insulating housing electrically insulating each of the plug-in pins from the other the plug-in pins.

17 Claims, 11 Drawing Sheets

PLUG-IN POWER CONTACTOR AND SYSTEM INCLUDING THE SAME

BACKGROUND

Field

The disclosed concept pertains generally to electrical switching apparatus and, more particularly, to electromagnetic switching devices, such as, for example, power contactors. The disclosed concept further pertains to systems including such power contactors.

Background Information

Electromagnetic switching devices, such as power contactors, are often used to electrically couple a power source to a load such as, for example and without limitation, an electrical motor or other suitable load. An electromagnetic switching device can include both fixed and movable electrical contacts as well as an electromagnetic coil. Upon energization of the electromagnetic coil, a movable contact engages a number of fixed contacts so as to electrically couple the power source to the load. When the electromagnetic coil is de-energized, the movable contact disengages from the number of fixed contacts thereby disconnecting the load from the power source.

Power contactors can include a plurality of inputs for a plurality of power sources and a plurality of outputs for a plurality of loads. The outputs can include normally open (NO) and/or normally closed (NC) outputs. Also, a number of NO and/or NC auxiliary switches can be provided that follow the state of the power contactor outputs.

Main power conductors can enter a power distribution panel through a power contactor, which is typically employed to open and close, thereby controlling power to the panel. Downstream of the power contactor in the panel is a circuit for sensing current. In a three-phase power panel, for example, downstream current transformers are employed for sensing the current, and upstream circuit breakers are employed for providing overcurrent, phase imbalance and/or ground fault protection.

There is room for improvement in power contactors.

There is also room for improvement in systems including power contactors.

SUMMARY

A power contactor that includes a number of inputs for a number of power sources, a number of outputs for a number of loads, a number of separable contacts for each pair of the number of inputs and the number of outputs, and an electromagnetic coil. The power contactor also includes a control circuit structured to control the electromagnetic coil to cause the number of separable contacts to open or close, a plurality of plug-in pins. Each of the plug-in pins is for a corresponding one of the number of inputs and the number of outputs, and is structured to plug into a backplane socket. The power contactor also includes an electrically insulating housing electrically insulating each of the plug-in pins from the other the plug-in pins.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "processor" shall mean a programmable analog and/or digital device that can store, retrieve, and process data; a computer; a workstation; a personal computer; a controller; a digital signal processor; a microprocessor; a microcontroller; a microcomputer; a central processing unit; a mainframe computer; a mini-computer; a server; a networked processor; or any suitable processing device or apparatus.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a three-phase alternating current (AC) power contactor for aircraft applications, although the disclosed concept is applicable to a wide range of power contactors having any number of phases for any suitable AC or direct current (DC) power application. The power contactor will be described as being either a single throw or a double throw power contactor for input of one or two sets, respectively, of three AC phases and output of one set of three AC phases. Alternatively, it will be appreciated that the power contactor can be employed as a single throw or a double throw power contactor for input of one set of three AC phases and output of one or two sets, respectively, of three AC phases with normally open (NO) and/or normally closed (NC) outputs.

Figure 1:
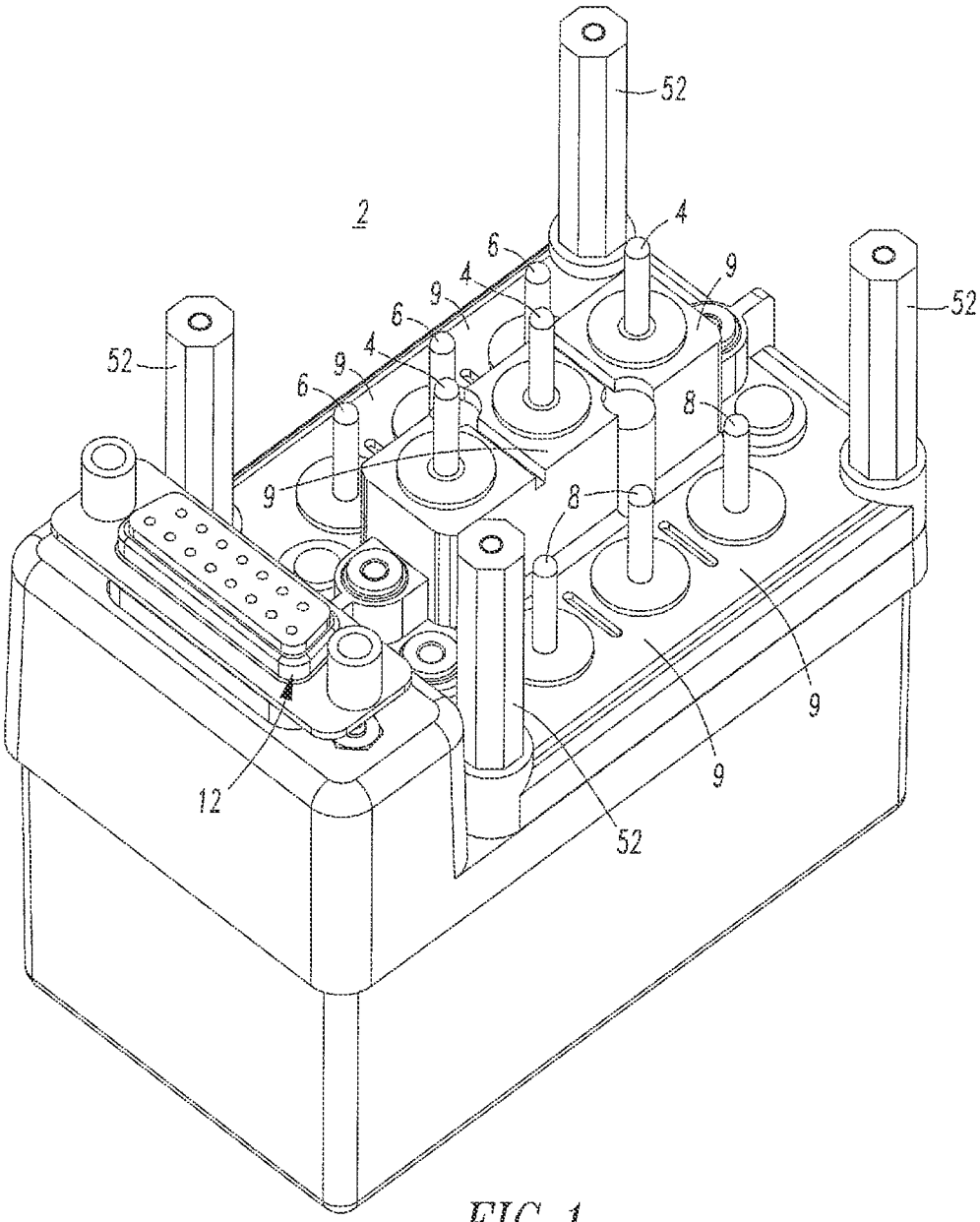
FIG. 1 is an isometric view of a power contactor in accordance with embodiments of the disclosed concept.

Referring to FIG. 1, a power contactor 2 includes three plug-in pins 4 for three separate AC power output lines (not shown) and six other plug-in pins 6,8 for AC power in (e.g., without limitation, a double throw power contactor including three NO inputs at pins 6 and three NC inputs at pins 8). In an alternative configuration, the three plug-in pins 4 can be employed for three separate AC power input lines (not shown) and the six other plug-in pins 6,8 for AC power out (e.g., without limitation, a double throw power contactor including three NO outputs at pins 6 and three NC outputs at pins 8). An electrically insulating housing 9 electrically insulates each of the plug-in pins 4,6,8 from each of the other plug-in pins. The housing 9 carries a 15-pin connector 12 for a power contactor coil control circuit 14 and houses auxiliary circuits 16 as will be discussed, below, in connection with FIG. 9.

Figure 2:
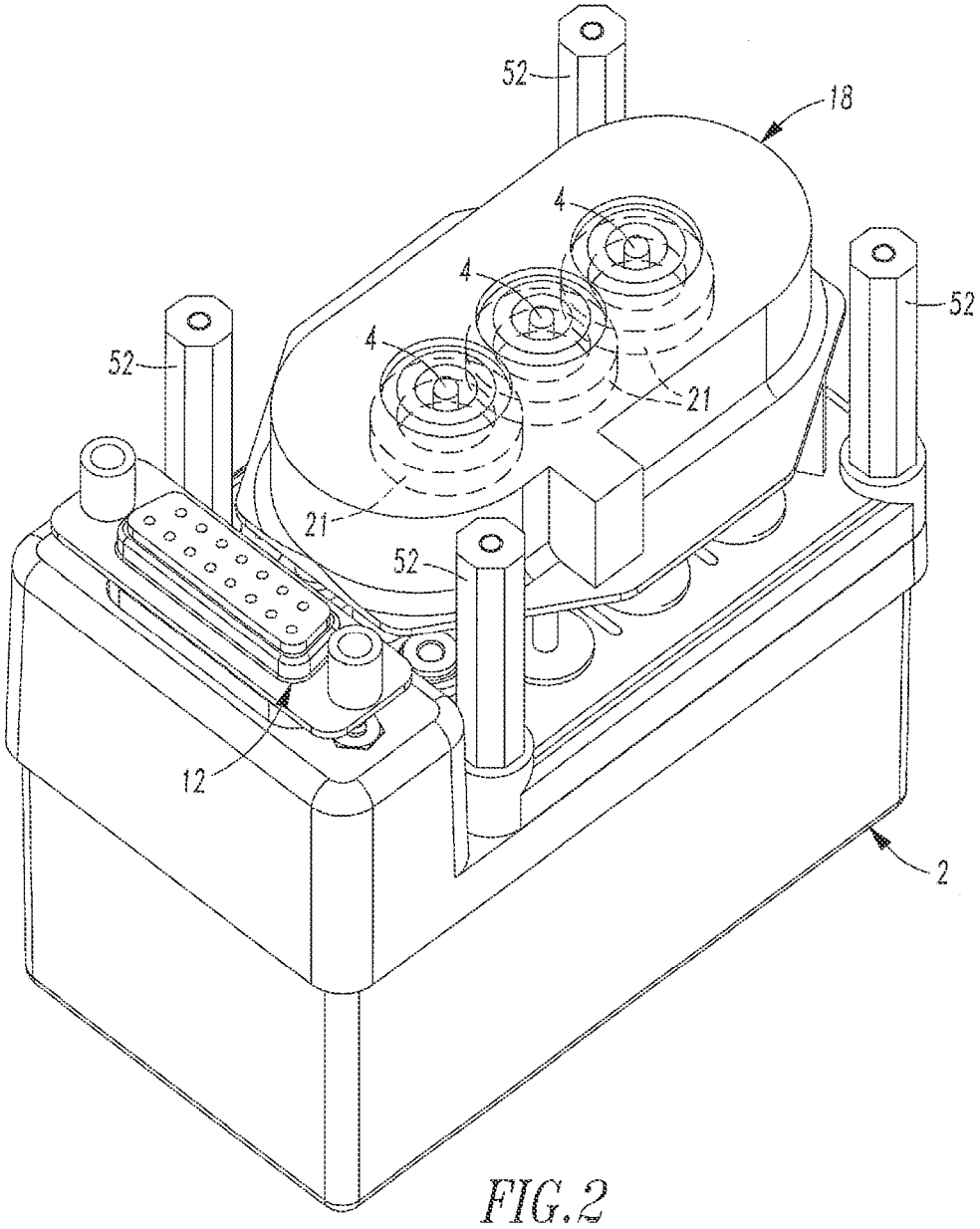
FIG. 2 is an isometric view of a power contactor and three current sensors (shown in hidden line drawing) for a current sensing and protection circuit in accordance with another embodiment of the disclosed concept.

As shown in FIG. 2, a molded piece 18 is added to the power contactor 2. Alternatively, the molded piece 18 can mount as a standalone item to a backplane printed circuit board (PCB) 20 (FIGS. 4A and 4B). The example molded piece 18 encloses and electrically insulates three current sensors, such as example current transformers (CTs) 21 (shown in hidden line drawing). The molded piece 18 and CTs 21 can function as a circuit module and electrically connect (e.g., without limitation, the CTs have wires (not shown) to connectors (not shown) that couple to the backplane PCB 20, or the CTs can have ridged pins (not shown) that plug into the backplane PCB 20) to the backplane PCB 20 (FIGS. 4A and 4B) in order to communicate with an external electrical load management system 22 (FIG. 7) or with a self-contained on-board electrical load management system (not shown, but this may be part of the control circuit 14 of FIG. 9). These components perform multiple functions and provide: (1) electrical isolation between the three pins 4 and the three example corresponding AC phases; (2) mounting of the power contactor 2 with the three CTs 21 (FIGS. 2 and 5), mounting of the three CTs 21 without the power contactor 2 (FIG. 4B), or no power contactor 2 and no CTs 21 with a direct latching pin and socket latching connector 24 (FIG. 5) by using the backplane PCB 20 with latching plug-in sockets 26 (FIG. 4C); and/or (3) mechanical positioning of a number of CTs (e.g., without limitation, three round CTs 21 for sensing line current and/or phase imbalance as shown in hidden line drawing in FIG. 2, or a single CT 28 for ground fault detection as shown in hidden line drawing in FIG. 3). The three individual CTs 21 sense phase current and the external electrical load management system 22 (FIG. 7) determines phase imbalance and/or overcurrent from the sensed three-phase currents. The single CT 28 senses the "summed current" (i.e., differential current, since the summed current is normally zero) of the three phases and compares that against a threshold for ground fault protection in the electrical load management system 30 (FIG. 8).

In the example application, DC power (not shown) is separated from the AC power and enters and exits through other points of connection (not shown). For example and without limitation, the DC power could have additional openings in a sealed grommet (not shown, but see the sealed grommets 10 for three AC phase voltages of FIG. 4A) for a number of DC voltages (not shown).

Figure 3:
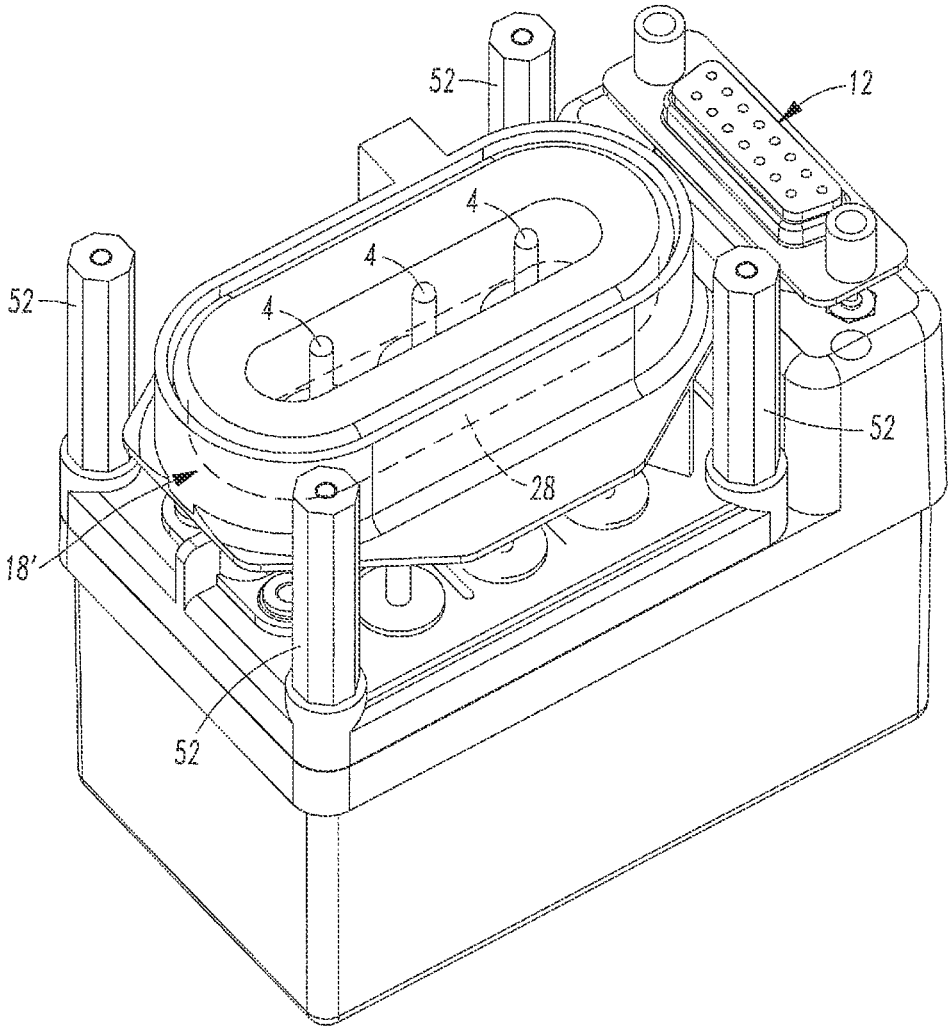
FIG. 3 is an isometric view of a power contactor and a single current sensor (shown in hidden line drawing) for a ground fault protection circuit in accordance with another embodiment of the disclosed concept.
Figure 4A:
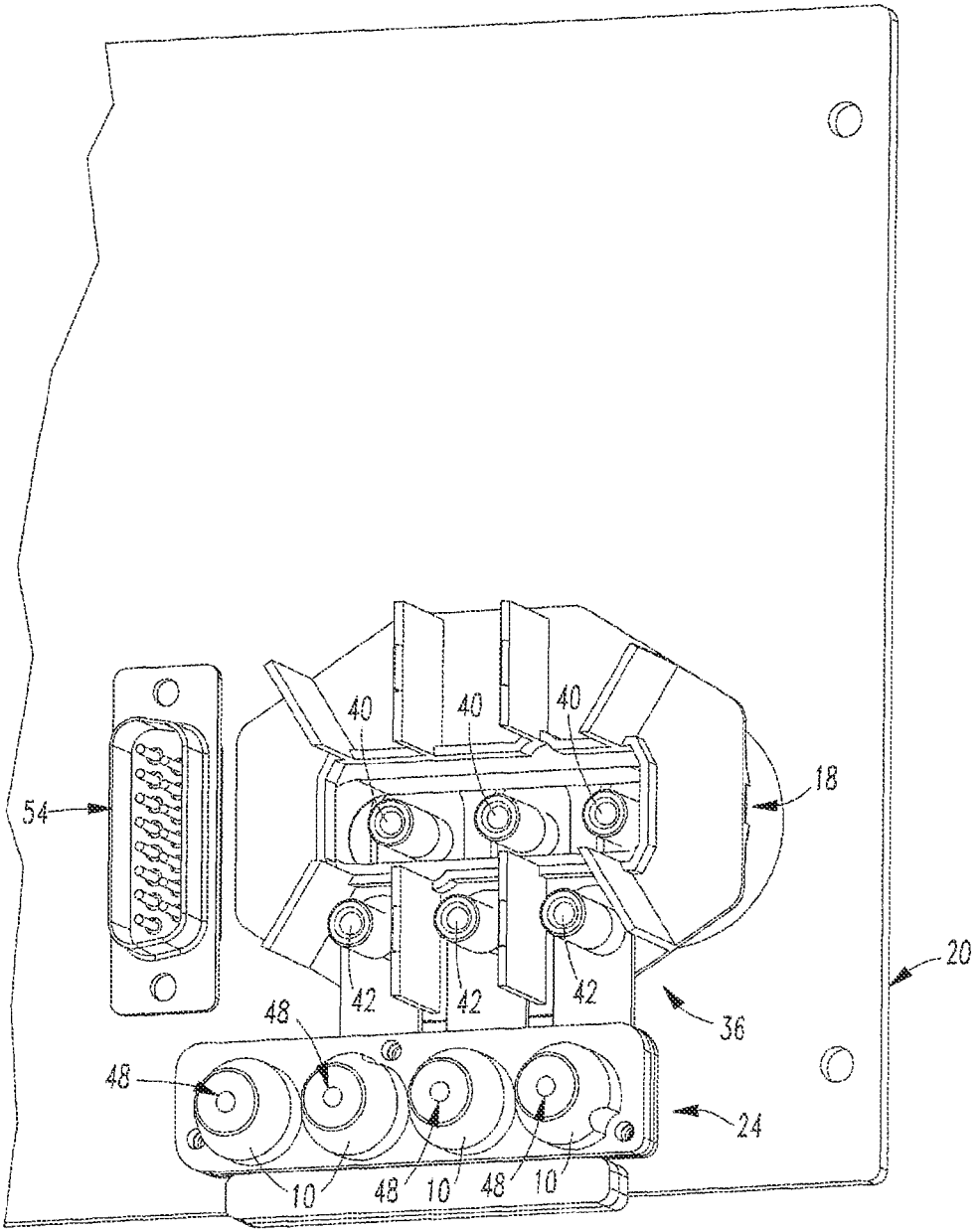
FIG. 4A is an isometric view of a printed circuit board including a socket that can accept the power contactor of FIG. 2 or FIG. 3.
Figure 4B:
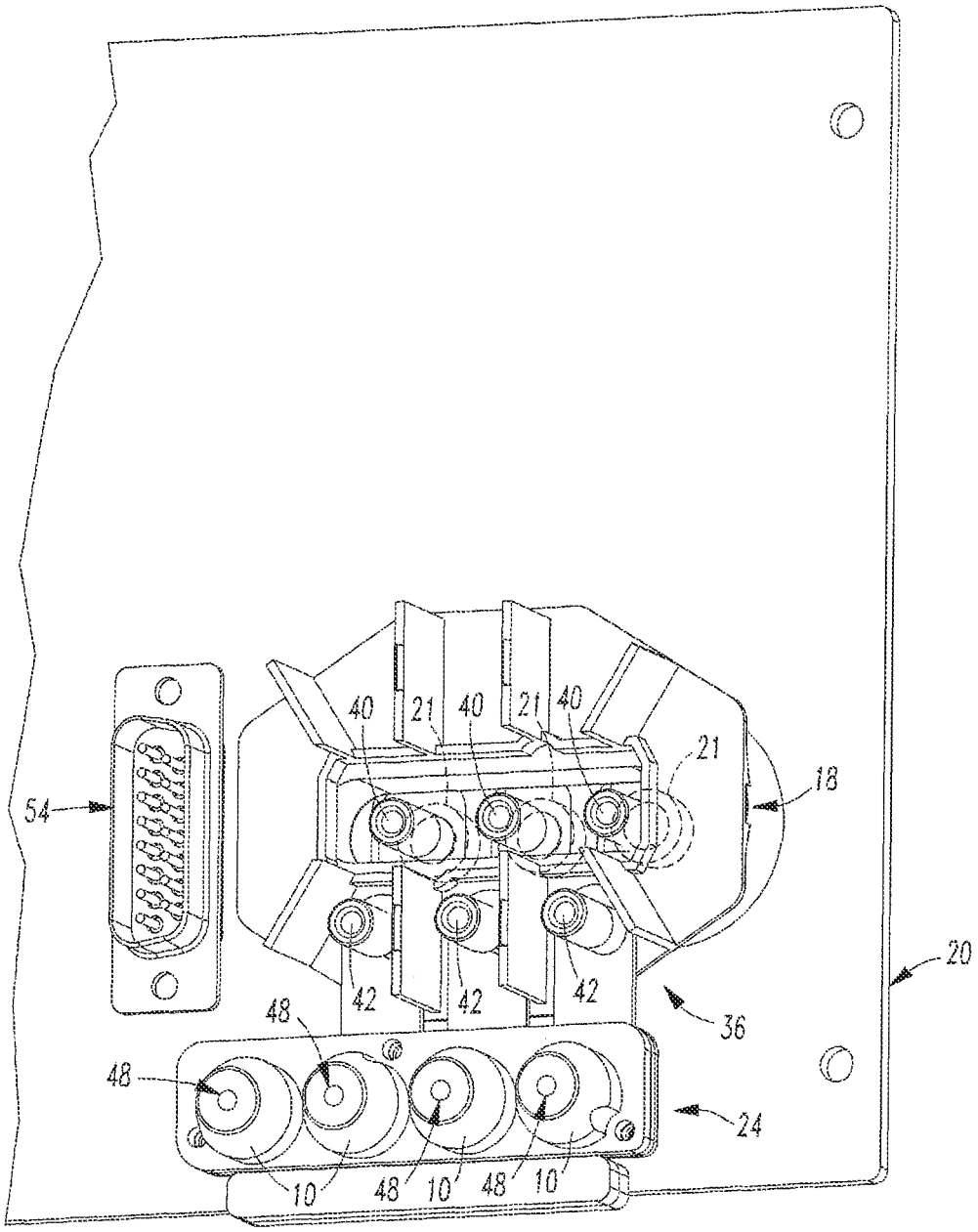
FIG. 4B is an isometric view of a printed circuit board including a socket accepting the three current sensors of FIG. 2.

In FIGS. 2 and 3, the six double throw pins 6,8 (shown in FIG. 1) are under the molded piece 18 or 18', respectively. The pins 6 and/or 8 of the power contactor 2 plug into a backplane socket 36 (e.g., the pins 6 plug into sockets 42 of the backplane socket 36 of FIG. 4A) that are part of the backplane PCB 20. If the power contactor 2 is not populated (FIG. 4C), then jumpers 56 (FIG. 4C) are employed. For example, the three pins 4 are electrically connected to a number of branch circuit breakers 31 (shown in FIGS. 7 and 8) which power loads (not shown) through two load connectors 32,34 as shown in FIG. 5.

Figure 4C:
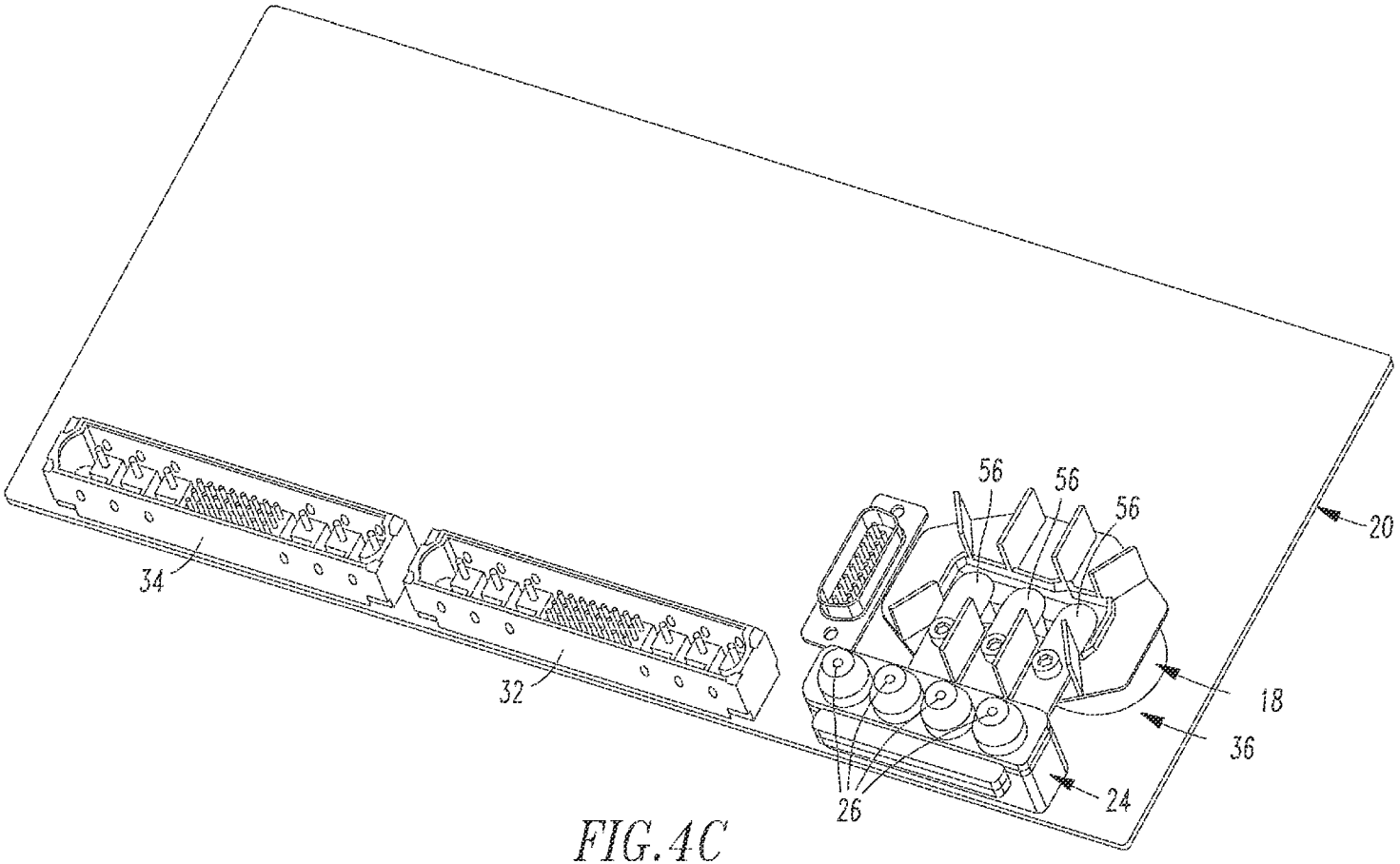
FIG. 4C is an isometric view of a printed circuit board including a socket without a power contactor or a current sensor and being jumpered to a latching feeder connector in order to power a backplane.
Figure 5:
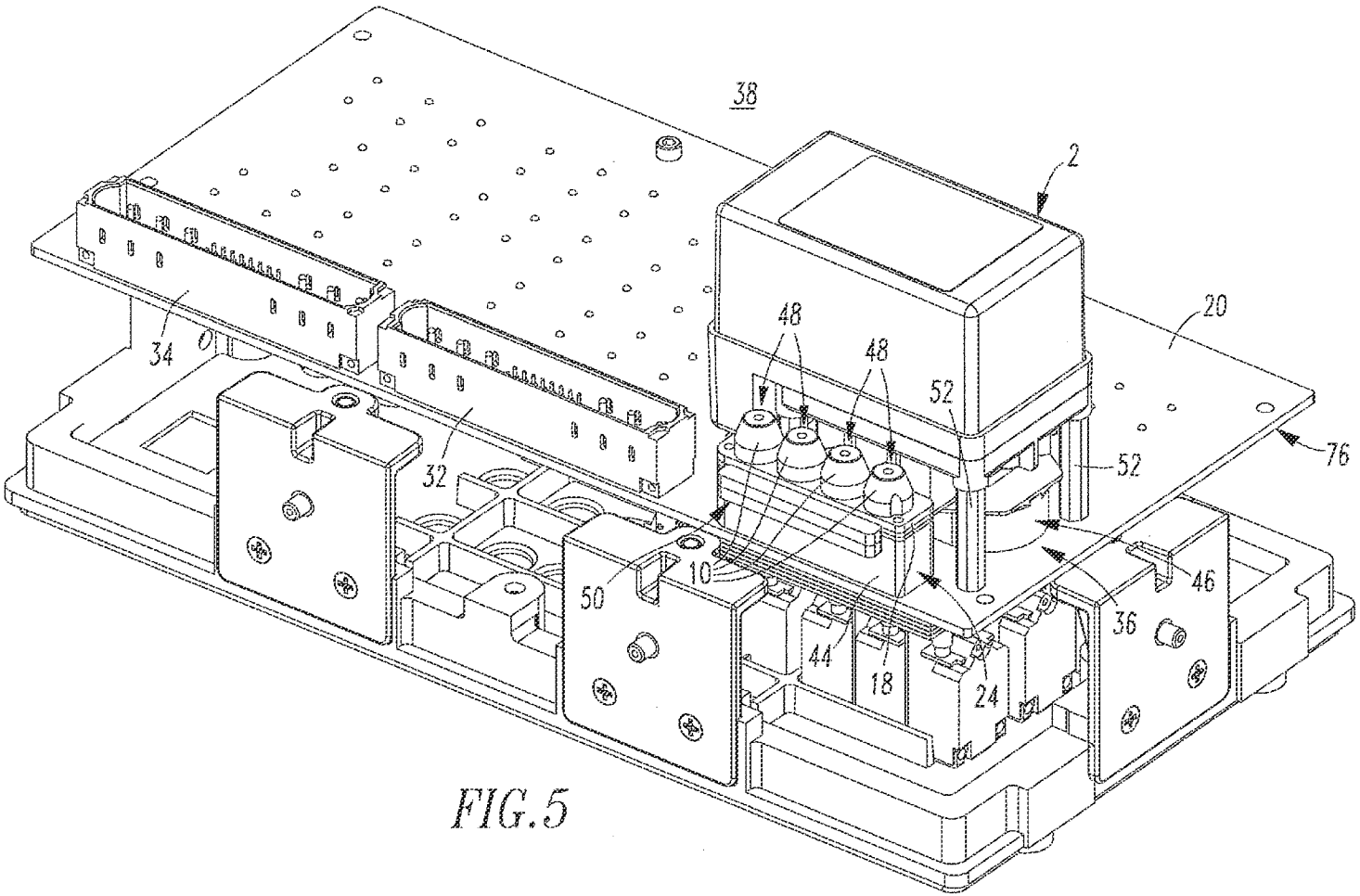
FIG. 5 is an isometric view of a power contactor plugged-into the socket of the printed circuit board of FIG. 4A.
Figure 6:
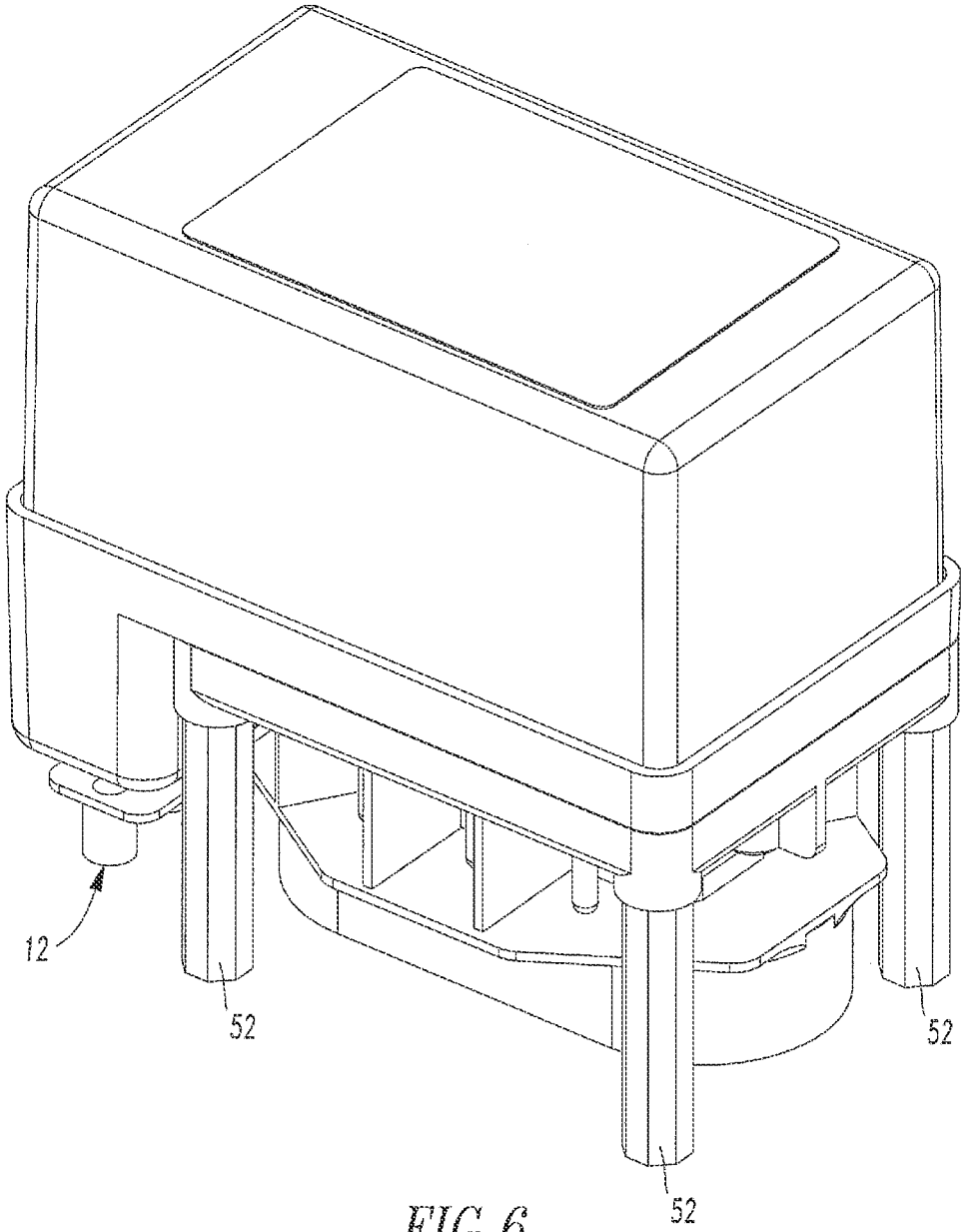
FIG. 6 is an isometric view of the power contactor and the three current sensors of FIG. 2 plugged-into the socket of FIG. 5.

In accordance with the disclosed concept, the power contactor 2 (FIG. 1) employs the plug-in pins 4,6,8 for plugging into a backplane socket 36 (FIGS. 4A and 5) of a circuit breaker module or main power distribution panel 38 (FIG. 5). The plug-in pins 4 are either individually surrounded with the individual CTs 21 (FIG. 2) or are all surrounded by the single CT 28 (FIG. 3) for respectively sensing current and/or phase imbalance or for use in ground fault protection. There is also the example direct latching pin and socket latching connector 24 (FIGS. 4A-4C and 5) on the backplane PCB 20 for line power conductors that are electrically connected to the backplane socket 36 for the power contactor 2.

FIG. 4A shows the backplane socket 36 mounted on the backplane PCB 20 with the molded piece 18 and including six exposed example sockets 40,42. This permits the flexibility of installing the power contactor 2 (FIG. 5) or not installing a power contactor (as shown in FIG. 4C). For example, panels (not shown) are often controlled by a master (not shown) with relatively smaller panels (not shown) being fed by relatively larger circuit breakers (not shown). In FIG. 4A, three sockets 40 cooperate with either the three round CTs 21 (FIGS. 2 and 4B) of the molded piece 18 or with the single CT 28 (FIG. 3) of the molded piece 18'. The three sockets 40 electrically engage the three power contactor pins 4 (FIG. 1) and the three sockets 42 are for the power contactor NO pins 6 (FIG. 1). The other three power contactor NC pins 8 (FIG. 1) are not used in this example. The three sockets 42 for the pins 6 are also electrically connected to the example four-conductor direct latching pin and socket latching connector 24, which is disclosed by U.S. Prov. Pat. Appl. Ser. No. 61/758,291, filed Jan. 30, 2013, which is incorporated by reference herein. This provides for the electrical connection of three lines and a ground (not shown) to the power contactor 2 and/or to the backplane PCB 20.

As shown in FIG. 5, the example connector 24 includes a non-conductive block assembly 44, a resilient wire support 46, and four example conductor units 48. The example connector 24 provides four electrical connections between a number of electrical devices (e.g., without limitation, a feeder (not shown) and the example power contactor 2). As shown, the connector 24 includes four example conductor units 48. The connector 24 may include any suitable plurality of conductor units 48. As shown in FIG. 5, the connector 24 is coupled to, and in electrical communication with, the backplane PCB 20, which is coupled to, and in electrical communication with, other electrical components (not shown, but see the circuit breakers 31 of FIGS. 7 and 8). Further, the connector 24 may be coupled to, and placed in electrical communication with, other electrical backplanes, electronics backplanes, or individual conductor pins/wires (not shown). Each of the conductor units 48 includes a suitable insulated conductor (not shown) from a power source (not shown), a pin (not shown) suitably crimped to the conductor (not shown) of the insulated conductor, and a socket (not shown) engaging the pin and being in electrical communication with the backplane PCB 20. A clip member 50 includes four example clip passages (not shown) each of which engages and retains a corresponding terminal pin crimped portion (not shown) of a corresponding one of the conductor units 48.

For example and without limitation, as shown in FIGS. 4A and 5, the direct latching pin and socket latching connector 24 for the power contactor 2 accepts line conductors (not shown) to power the backplane PCB 20 and/or the power contactor 2, which is bolted into place on the backplane PCB 20 using the four example hex standoffs 52 and four screws or other suitable fasteners (not shown). The example power contactor 2 first plugs-in to the backplane socket 36 of the backplane PCB 20 and then it is held in place by the four screws or fasteners on the other side of the backplane PCB 20. In the example application, due to the weight of the power contactor 2, the screws are employed to retain the power contactor 2. Alternatively, this can be accomplished with other suitable mechanisms for latching or locking in the power contactor.

As shown in FIG. 4A, another 15-pin connector 54 connects to and accepts the corresponding 15-pin connector 12 of the power contactor 2 (FIG. 1).

Figure 7:
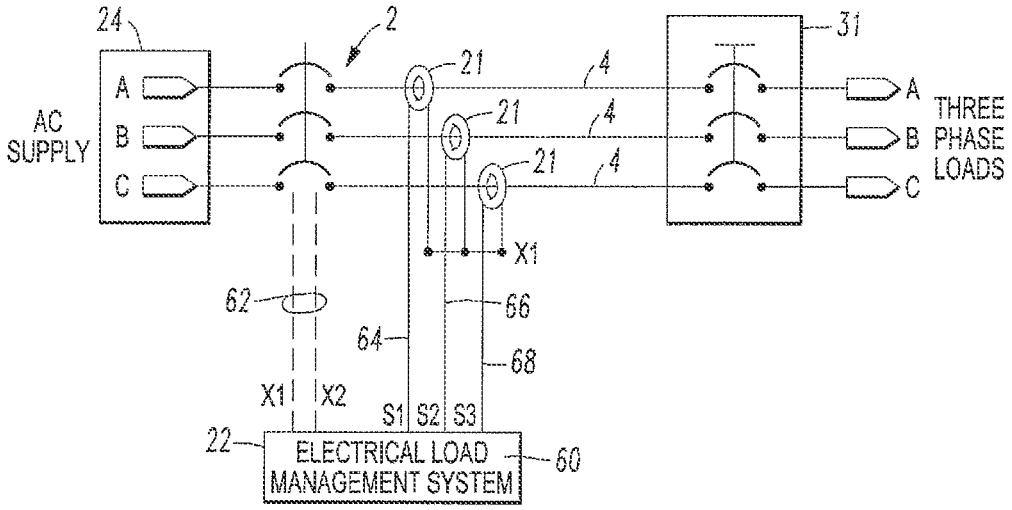
FIG. 7 is a block diagram in schematic form of a system including the power contactor, the three current sensors and the current sensing and protection circuit of FIG. 2 for sensing line current and/or phase imbalance in accordance with another embodiment of the disclosed concept.
Figure 8:
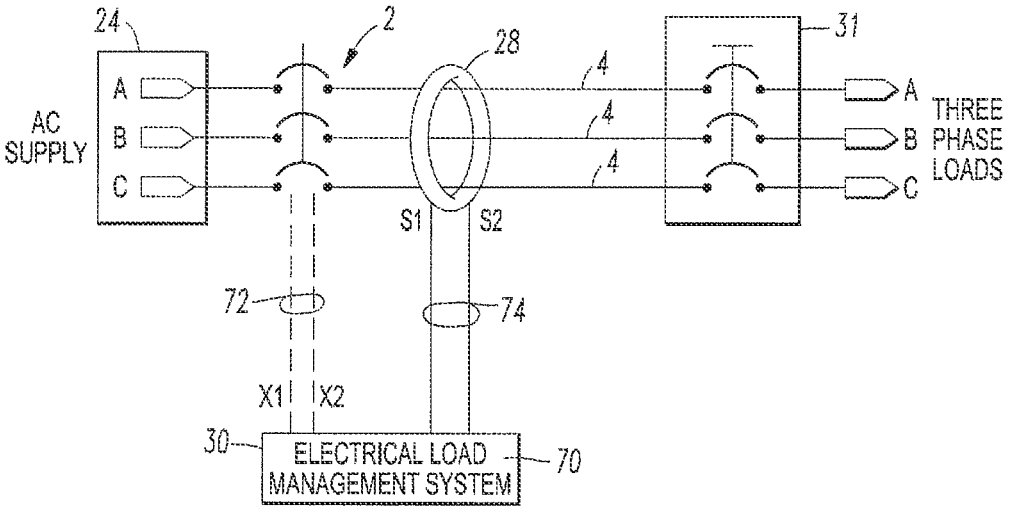
FIG. 8 is a block diagram in schematic form including the power contactor, the single current sensor and the current sensing and protection circuit of FIG. 3 for providing ground fault detection in accordance with another embodiment of the disclosed concept.

FIG. 4B shows the backplane PCB 20 including the backplane socket 36 accepting the three CTs 21 (shown in hidden line drawing) for the current sensing and protection circuit of FIG. 2 (not shown, but see, for example, the electrical load management system 22 of FIG. 7).

FIG. 4C shows the backplane PCB 20 including the backplane socket 36 without a power contactor or current sensor and being jumpered by three jumpers 56 for three AC phases to the direct latching pin and socket latching connector 24 in order to power the backplane PCB 20 from the connector 24 and through the socket 36.

The current sensing (FIG. 2 or 3) is modular with the power contactor 2 (FIG. 5) or without a power contactor (FIG. 4C) since the molded pieces 18 or 18' can optionally contain the respective CTs 21 or 28. The power contactor 2 can be populated or not populated depending upon the application. The backplane power bus work (not shown) is set-up (e.g., without limitation, the power bus work is suitably jumpered at the corresponding backplane socket 36 without a power contactor present) (FIG. 4C) in order to power the panel with or without a power contactor. The individual and/or ground fault sensing CT options (FIGS. 7 and 8) can optionally be not employed by simply not populating the corresponding CT(s) 21 or 28.

As shown in FIG. 5, main power conductors (not shown) enter the power distribution panel or circuit breaker module 38 through the four example conductor units 48 each of which enters through a corresponding one of the sealed grommets 10 and employs latching pins (not shown) to feed power thereto with or without the power contactor 2. The power distribution panel or circuit breaker module 38 employs embedded pins 4,6,8 (FIG. 1) and sockets 40,42 (FIG. 4A) and greatly reduces the use of point-to-point wiring. The power contactor 2 is typically used for opening and closing power to the panel or the circuit breaker module 38. In some embodiments, the power contactor 2 can also interrupt power to the panel or the circuit breaker module 38.

Phase sensing and/or phase imbalance (FIG. 7) and/or differential fault protection (FIG. 8) can be provided by the power contactor 2 (e.g., in the control circuit 14 of FIG. 9) or remotely in a master power center (not shown) or in the electrical load management system 22 (FIG. 7) or 30 (FIG. 8). In FIG. 7, the electrical load management system 22 includes a suitable processor, such as the example controller 60, that outputs a contactor coil control signal 62 on lines X1,X2 and inputs current sense signals 64 (A), 66 (B), 68 (C) on lines S1,S2,S3, respectively. It will be appreciated that the lines X1,X2,S1,S2,S3 can be part of the backplane PCB 20 of FIG. 5. The controller 60 can provide on/off control of the power contactor 2 as well as a number of protection routines (e.g., without limitation, overcurrent on individual phases A, B and/or C; phase imbalance on the three phases A, B and C). The three-phase power contactor 2 inputs power from the three phase lines A,B,C and outputs power to the three-phase circuit breaker (CB) 31, which powers a number of three-phase loads (not shown).

In FIG. 8, the electrical load management system 30 includes a suitable processor, such as the example controller 70, that outputs a contactor coil control signal 72 on lines X1,X2 and inputs a differential current sense signal 74 from the single CT 28. The controller 70 can provide on/off control of the power contactor 2 as well as a number of protection routines (e.g., without limitation, ground fault protection). The three-phase power contactor 2 inputs power from the three phase lines A,B,C and outputs power to a three-phase circuit breaker (CB) 31, which powers a number of three-phase loads (not shown). It will be appreciated that the lines X1,X2,S1,S2 can be part of the backplane PCB 20 of FIG. 5.

The backplane PCB 20 (FIG. 5) preferably is a plug-in thermally conductive backplane. An example of such a structure for circuit breakers is disclosed by U.S. Pat. No. 8,094,436, which is incorporated by reference herein. The electrical bus structure 76 of the backplane PCB 20 can include a plurality of layers (not shown) that form a conductive power bus (not shown). Each of the layers can be sandwiched between two corresponding layers (not shown) of a thermally conductive thermoplastic. For example, one of the layers can be bonded to a corresponding one of the layers of the thermally conductive thermoplastic by an epoxy-based structural tape (not shown). For example, three different layers can be employed for a three-phase AC application. The example electrical bus structure 76 can employ, for example and without limitation, a relatively thin laser cut or stamped copper bussing for the layers. The example copper bussing can be sandwiched between the layers of the thermally conductive thermoplastic (e.g., without limitation, 0.060 in. thickness thermally conductive LCP thermoplastic). A same or similar backplane structure can be employed for the power contactor 2 and/or circuit breakers 31 (e.g., as shown in FIGS. 7, 8 and 10).

Figure 9:
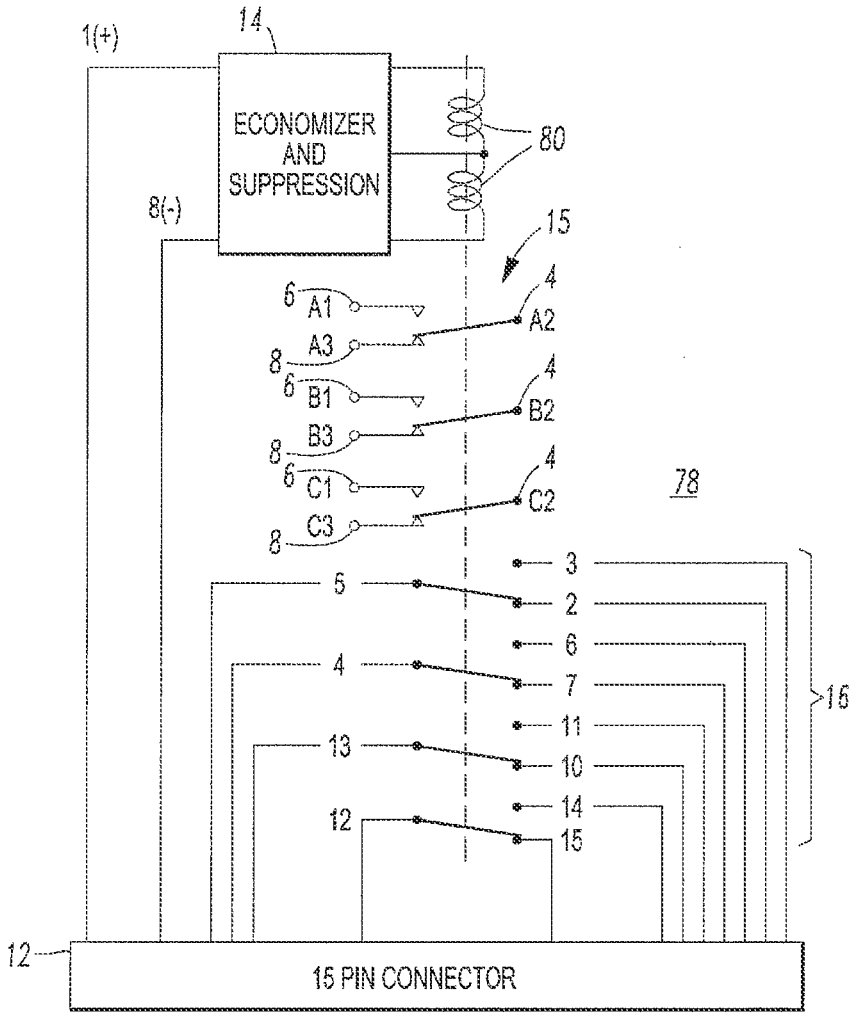
FIG. 9 is a block diagram in schematic form of a power contactor including a control circuit, a contactor coil, separable contacts, NO and NC outputs, and auxiliary contacts in accordance with another embodiment of the disclosed concept.

FIG. 9 shows a power contactor 78, which can be the same as or similar to the power contactor 2 of FIG. 1. The power contactor 78 includes a control circuit 14, separable contacts 15, a contactor coil 80, outputs A2,B2,C2 corresponding to the pins 4, three-phase NO inputs A1,B1,C1 corresponding to the pins 6, three-phase NC inputs A3,B3, C3 corresponding to the pins 8, and the auxiliary circuits 16 including a plurality of auxiliary contacts 17. Also shown is the example 15-pin connector 12.

Figure 10:
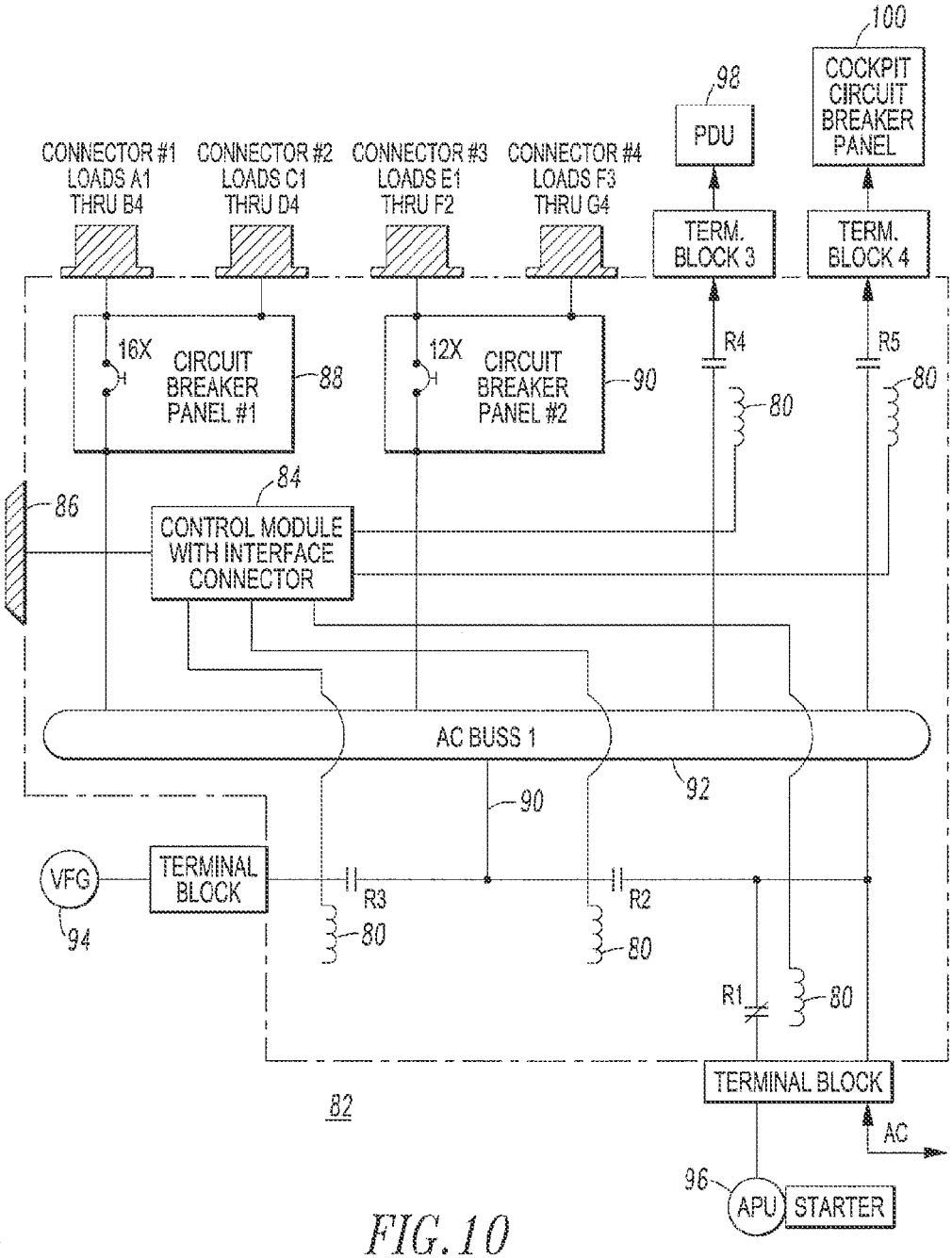
FIG. 10 is a simplified block diagram of a three-phase system including five of the power contactors of FIG. 1.

FIG. 10 shows an example three-phase system 82 (the three phases are shown as a single phase for simplicity of illustration; alternatively, any suitable number of phases can be employed) including five power contactors R1,R2,R3, R4,R5, which are the same as or similar to the power contactor 2 of FIG. 1. Power contactors R2-R5 use the NO inputs (the pins 6 of FIG. 1) while the power contactor R1 uses the NC inputs (the pins 8 of FIG. 1). Each of the power contactors R1-R5 includes a corresponding closing coil 80 that is controlled by a control module 84 including a control interface connector 86. Through the control interface connector 86, commands can be provided to open or close any of the power contactors R1-R5. Also, system status, auxiliary contact states, power contactor states and/or current sensing information can be provided to an electrical management system (not shown). Optionally, the control module 84 can sense current at the output(s) of the circuit breaker(s) 88,90 and/or at the input 90 to an AC BUSS 92. VFG (variable frequency generator) 94 and APU (auxiliary power unit) 96 are respective main and back-up AC sources that are selected by the power contactors R1-R3. The power contactor R4, when closed, powers a PDU (power distribution unit) 98 via an air turbine (RAM AIR) (not shown) and the power contactor R5, when closed, powers a cockpit circuit breaker panel 100. This permits the use of multiple power sources (e.g., left and right main power generators in line with the respective left and right aircraft engines to provide rotational energy/power), multiple power contactors, such as for ground power and the APU 96, and, in an emergency, ram air turbine power.

The disclosed concept can be used for the example circuit breaker module or main power distribution panel 38 with the power contactor 2. Most applications have the power contactor 2 in an electrical load management system, such as the example three-phase system 82 of FIG. 10. For example, for a galley application, there are multiple panels daisy chained together, with a master panel having a galley load contactor.

The disclosed concept provides various benefits including: (1) volume reduction since the current sensing is modular and is either with the power contactor 2 or without a power contactor; (2) achieving simplicity since the power contactor 2 simply plugs into the backplane socket 36 of the example circuit breaker module or main power distribution panel 38; (3) the power contactor 2 and a number of current sensors (e.g., without limitation, CTs 21 or 28) are packaged together; and (4) the power contactor 2 can accommodate modular overcurrent, phase imbalance and/or ground fault protection, thereby eliminating the need for a number of upstream thermal and/or ground fault circuit breakers.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A power contactor comprising:
- a number of inputs for a number of power sources;
- a number of outputs for a number of loads;
- a number of separable contacts for each pair of said number of inputs and said number of outputs;
- an electromagnetic coil;
- a control circuit structured to control said electromagnetic coil to cause said number of separable contacts to open or close;
- a plurality of plug-in pins, each of said plug-in pins being for a corresponding one of said number of inputs and said number of outputs, and being structured to plug into a backplane socket; and
- an electrically insulating housing electrically insulating each of said plug-in pins from the other said plug-in pins.

2. The power contactor of claim 1 wherein said number of inputs are a plurality of inputs, said number of power sources is a plurality of power sources, said number of outputs is a plurality of outputs, and said number of loads is a plurality of loads.

3. The power contactor of claim 1 wherein said number of inputs is an input, said number of power sources is a power source, said number of outputs is an output, and said number of loads is a load.

4. The power contactor of claim 1 wherein each of said number of outputs includes at least one of a normally open output and a normally closed output.

5. The power contactor of claim 1 wherein the electrically insulating housing houses a number of auxiliary switches structured to follow a number of states of said number of outputs.

6. The power contactor of claim 5 wherein said electrically insulating housing carries a connector interfacing said number of auxiliary switches and said control circuit.

7. The power contactor of claim 1 wherein said number of outputs are a plurality of outputs; and wherein said electrically insulating housing cooperates with a molded piece carrying a plurality of current sensors structured to sense a current flowing from each of said outputs, or carrying a single current sensor structured to sense a differential current flowing with respect to all of said outputs.

8. The power contactor of claim 1 wherein said electrically insulating housing cooperates with a molded piece carrying and electrically insulating a number of current transformers structured to sense a current flowing from each of said number of outputs, or carrying and electrically insulating a single current transformer structured to sense a differential current flowing with respect to all of a plurality of said number of outputs; and wherein said molded piece mechanically positions each of said number of current transformers about a corresponding one of said number of outputs or mechanically positions said single current transformer about said all of said plurality of said number of outputs.

9. The power contactor of claim 1 further comprising a molded piece that is standalone from the electrically insulating housing and carried by the backplane socket, said molded piece carrying a number of current sensors structured to sense a current flowing from each of said number of outputs, or carrying a single current sensor structured to sense a differential current flowing with respect to all of a plurality of said number of outputs.

10. The power contactor of claim 1 wherein said electrically insulating housing cooperates with and carries a molded piece carrying a number of current sensors structured to sense a current flowing from each of said number of outputs, or cooperates with and carries a single current sensor structured to sense a differential current flowing with respect to all of a plurality of said number of outputs.

11. A system comprising:
- a backplane;
- a backplane socket disposed on said backplane; and
- a power contactor comprising:
  - a plurality of inputs for a plurality of power sources,
  - a plurality of outputs for a plurality of loads,
  - a plurality of separable contacts, one for each pair of said inputs and said outputs,
  - an electromagnetic coil,
  - a control circuit structured to control said electromagnetic coil to cause said separable contacts to open or close,
  - a plurality of plug-in pins, each of said plug-in pins being for a corresponding one of said inputs and said outputs, and being plugged into said backplane socket and in electrical communication therewith, and an electrically insulating housing electrically insulating each of said plug-in pins from the other said plug-in pins.

12. The system of claim 11 wherein said backplane is part of a circuit breaker module or main power distribution panel.

13. The system of claim 11 wherein said backplane includes a plurality of first conductors powered from the plurality of power sources, a plurality of circuit breakers and a plurality of second conductors, said first conductors being electrically connected to said plurality of inputs through said backplane socket, said second conductors being electrically connected to said circuit breakers and being electrically connected to said plurality of outputs through said backplane socket; and wherein said power contactor is structured to open and close said separable contacts, thereby controlling power to said circuit breakers.

14. The system of claim 13 wherein said backplane further includes a latching connector electrically and mechanically receiving a plurality of third conductors from the plurality of power sources and outputting the first conductors powered from the plurality of power sources.

15. The system of claim 11 wherein said backplane is a thermally conductive backplane.

16. The system of claim 11 wherein said electrically insulating housing carries a first connector interfacing said control circuit; and wherein said backplane carries a second connector connected to said first connector.

17. The system of claim 11 wherein said backplane includes a latching connector electrically and mechanically receiving a plurality of alternating current phase conductors and outputting a plurality of first conductors; wherein said backplane further includes a plurality of second conductors, said second conductors being electrically connected to said plurality of inputs through said backplane socket; and wherein said power contactor is structured to open and close said separable contacts, thereby controlling power to said plurality of outputs.

* * * * *